US008757868B2

(12) United States Patent
Karapatis et al.

(10) Patent No.: US 8,757,868 B2
(45) Date of Patent: Jun. 24, 2014

(54) METHOD OF FABRICATING A TIMEPIECE BALANCE SPRING ASSEMBLY IN MICRO-MACHINABLE MATERIAL OR SILICON

(75) Inventors: Nakis Karapatis, Premier (CH); Pierre Cusin, Villars-Burquin (CH)

(73) Assignee: Montres Breguet SA, L'Abbaye (CH)

( * ) Notice: Subject to any disclaimer, the term of this patent is extended or adjusted under 35 U.S.C. 154(b) by 490 days.

(21) Appl. No.: 13/164,124

(22) Filed: Jun. 20, 2011

(65) Prior Publication Data

US 2011/0310710 A1 Dec. 22, 2011

(30) Foreign Application Priority Data

Jun. 21, 2010 (EP) ..... 10166685

(51) Int. Cl.
*G04B 17/04* (2006.01)

(52) U.S. Cl.
USPC ..... 368/127; 368/175; 368/177

(58) Field of Classification Search
USPC ..... 368/175, 176–178, 127, 168–169
See application file for complete search history.

(56) References Cited

U.S. PATENT DOCUMENTS

| | | | | |
|---|---|---|---|---|
| 7,950,847 | B2 * | 5/2011 | Zaugg et al. | 368/175 |
| 8,215,828 | B2 * | 7/2012 | Zaugg et al. | 368/175 |
| 8,296,953 | B2 * | 10/2012 | Buhler et al. | 29/896.31 |
| 8,322,914 | B2 * | 12/2012 | Bifrare et al. | 368/177 |
| 8,425,110 | B2 * | 4/2013 | Zaugg et al. | 368/177 |
| 8,480,294 | B2 * | 7/2013 | Helfer et al. | 368/175 |
| 2010/0110840 | A1 | 5/2010 | Zaugg et al. | |
| 2010/0149927 | A1 | 6/2010 | Zaugg et al. | |
| 2010/0283556 | A1 | 11/2010 | Hessler et al. | |

FOREIGN PATENT DOCUMENTS

| | | | |
|---|---|---|---|
| EP | 1 843 227 | A1 | 10/2007 |
| EP | 2 184 652 | A1 | 5/2010 |
| EP | 2 196 867 | A1 | 6/2010 |
| FR | 2315714 | * | 6/1975 |

OTHER PUBLICATIONS

Curve—Horology dictionary; fhs.ch.berner/?1=en—Dec. 10, 2013.*

* cited by examiner

*Primary Examiner* — Sean Kayes
(74) *Attorney, Agent, or Firm* — Sughrue Mion, PLLC

(57) ABSTRACT

A method of fabricating a balance spring assembly (1) in silicon including a hairspring (2) made in a wafer of given crystalline orientation, in a plane (P). The volume of the assembly (1) is broken down into sub-components, inscribed in parallelepiped prisms, in secant pairs, at the junction areas, perpendicular to each other, each made in a wafer selected for the thickness or crystalline orientation thereof. An outer curve (4) is made in an orthogonal plane to that of the hairspring (2) joining it directly to a point in space, the projection of which into the plane (P) is located external to the hairspring (2). The sub-components are assembled at the junction areas.

12 Claims, 2 Drawing Sheets

METHOD OF FABRICATING A TIMEPIECE BALANCE SPRING ASSEMBLY IN MICRO-MACHINABLE MATERIAL OR SILICON

FIELD OF THE INVENTION

The invention concerns a method of fabricating a balance spring assembly in micro-machinable material or silicon and in three dimensions, including at least a first flat component formed by a hairspring, made of micro-machinable material or silicon in a wafer of micro-machinable material or silicon, with a given crystalline orientation, said first component extending on one side from a base plane.

The invention also concerns a balance spring assembly including a flat hairspring and a terminal curve.

The invention also concerns a timepiece incorporating at least one point of attachment which includes securing means.

The invention also concerns a timepiece including at least one stud for attaching a balance spring, said stud including securing means.

The technical field is that of micro-mechanical components, and in particular timepieces made of micro-machinable material or silicon, or suchlike.

More specifically, the field is that of three-dimensional components, such as those comprising regulating members and particularly balance springs, or pallets, or tourbillon carriages or karussels, or suchlike.

The invention will be more particularly described for the preferred application of a silicon balance spring.

BACKGROUND OF THE INVENTION

Some timepiece balances springs, such as Breguet overcoils, include an outer terminal curve in a particular bent shape, or in a particular curve such as the Phillips curve, and the terminal curve is pinned up to a stud. In the case of a flat balance spring, this balance spring stud is in a different plane to that of the spring, and the projection of its position into the plane of the spring can be located anywhere relative thereto, within or outside the spring's range of movement. In the case of a cylindrical or other type of balance spring, the stud may occupy any position in space.

The use of silicon has allowed great progress to be made in watch making, in particular by using silicon hairsprings for high oscillation frequencies, notably 10 Hz.

Techniques implementing silicon enable flat components to be made, by DRIE (deep reactive ion etching), and complex geometries to be obtained. For three-dimensional components, the fabrication possibilities are limited to parallel, multi-layered components, and it is possible to combine various fabrication methods: assembly, multi-level etching, wafer bonding or others. These fabrication methods are generally limited to putting together flat sub-components, which may be staged, assembled in different levels.

It is not possible, with these techniques, to fabricate a bent balance spring with an outer terminal curve rising in a gentle slope upwards to the higher point of attachment to the stud. Nor is it possible to make components with strong curves.

Indeed, if the stud is located much higher than the plane of the balance spring, the terminal curve must allow a proper assembly to be made between the body of the balance spring and the stud.

Thus, in order to overcome these mechanical problems, complex silicon parts in three-dimensions need to be made.

EP Patent Application No. 2 184 652 in the name of MONTRES BREGUET proposes a paraxial solution with an assembly between two parallel flat curves in micro-machinable material via a joint bar perpendicular to the planes of these two flat curves, which constitutes substantial progress relative to the prior art.

EP Patent Application No. 2 196 867 A1 in the name of MONTRES BREGUET discloses a balance spring with terminal curve elevation, made of silicon-based material, including an elevation device between the outer coil and the terminal coil of the balance spring.

EP Patent Application No. 1 843 227 A1 in the name of The Swatch Group Research and Development Ltd discloses a coupled resonator including a balance spring and a tuning fork, resonating at different frequencies, and including permanent mechanical coupling means.

SUMMARY OF THE INVENTION

The present invention proposes making the assembly between a flat hairspring in micro-machinable material and a stud via a curve with a strong curvature that develops in space in a different plane to that of the hairspring.

The invention therefore concerns a method of fabricating a timepiece balance spring assembly in micro-machinable material or silicon and in three dimensions, including at least a first flat component formed by a hairspring in micro-machinable material or silicon made in a wafer of micro-machinable material or silicon with a given crystalline orientation, said first component extending on one side from a base plane, characterized in that:

the volume of said balance spring assembly is broken down into elementary volumes, each inscribed in an elementary parallelepiped prism, said elementary prisms being secant at least in pairs to a junction area, said elementary volumes being perpendicular to each other and forming the same number of sub-components, each made in a wafer of micro-machinable material or silicon determined by the thickness and crystalline orientation thereof, each said wafer extending parallel to a wafer plane;

at least one of said sub-components, called the second component, is made to form a terminal curve of said balance spring assembly, directly joining said at least one hairspring at a point in space, the projection of which into said base plane is located external to said hairspring, said terminal curve being in an orthogonal plane to that of said at least one hairspring;

said sub-components are assembled at said junction areas by assembling means.

According to one feature of the invention, said terminal curve includes at least one curvature in the plane located between the two faces closest to said wafer from which it originates, and whose centre of curvature is located between said parallel faces.

According to another feature, said terminal curve joins said at least one flat hairspring to a stud located, in projection into said base plane, outside said hairspring.

According to a feature of a first variant of the invention, the smallest dimension of the smallest section of said terminal curve corresponds to the smallest dimension of said wafer from which it originates.

According to a feature of a second variant of the invention, the largest dimensions of the smallest section of said terminal curve corresponds to the smallest dimension of said elementary prism from which it originates.

According to another feature of the invention, said terminal curve has a "Phillips" curve type profile.

According to yet another feature of the invention, said balance spring assembly includes only said terminal curve and said flat hairspring.

The invention also concerns a timepiece balance spring assembly realised by this method, and intended to be secured to a point of attachment of a timepiece which includes securing means, wherein said balance spring assembly includes at least one said first component in a base plane, such that the projection of said point of attachment into said base plane and said hairspring are external to each other, and at least said terminal curve for attaching said assembly to said point of attachment, and characterized in that said terminal curve includes complementary securing means arranged for the assembly and securing thereof to said securing means of said point of attachment.

The invention also concerns a timepiece including at least one point of attachment which includes securing means, characterized in that it includes at least such one balance spring assembly, the terminal curve of which is fixed to said point of attachment via cooperation between said complementary securing means of said terminal curve and said securing means of said point of attachment.

The invention more specifically concerns a timepiece including at least one stud for attaching a balance spring, wherein said stud includes securing means, characterized in that said timepiece includes at least such one balance spring assembly, and in that said terminal curve includes complementary securing means arranged for the assembly and securing thereof to said securing means of said stud.

Thus, by using sub-components each made in a wafer and assembled, preferably perpendicularly, to each other, it is possible to integrate curved elements, or elements of dimensions incompatible with conventional techniques, which are often limited to diagonal wafer dimensions of between 100 and 300 mm.

In particular, the invention enables a flat silicon hairspring to be attached to a stud, which is located much higher than the plane of the hairspring, and the projection of which into said plane is external to said hairspring.

The method according to the invention also advantageously allows the assembly of sub-components, which are derived from wafers of different crystalline orientations, thus enabling advantage to be taken of any elastic properties if required.

BRIEF DESCRIPTION OF THE DRAWINGS

Other features and advantages of the invention will appear upon reading the following description, with reference to the annexed drawings, in which.

DETAILED DESCRIPTION OF PREFERRED EMBODIMENTS

Figure 1:
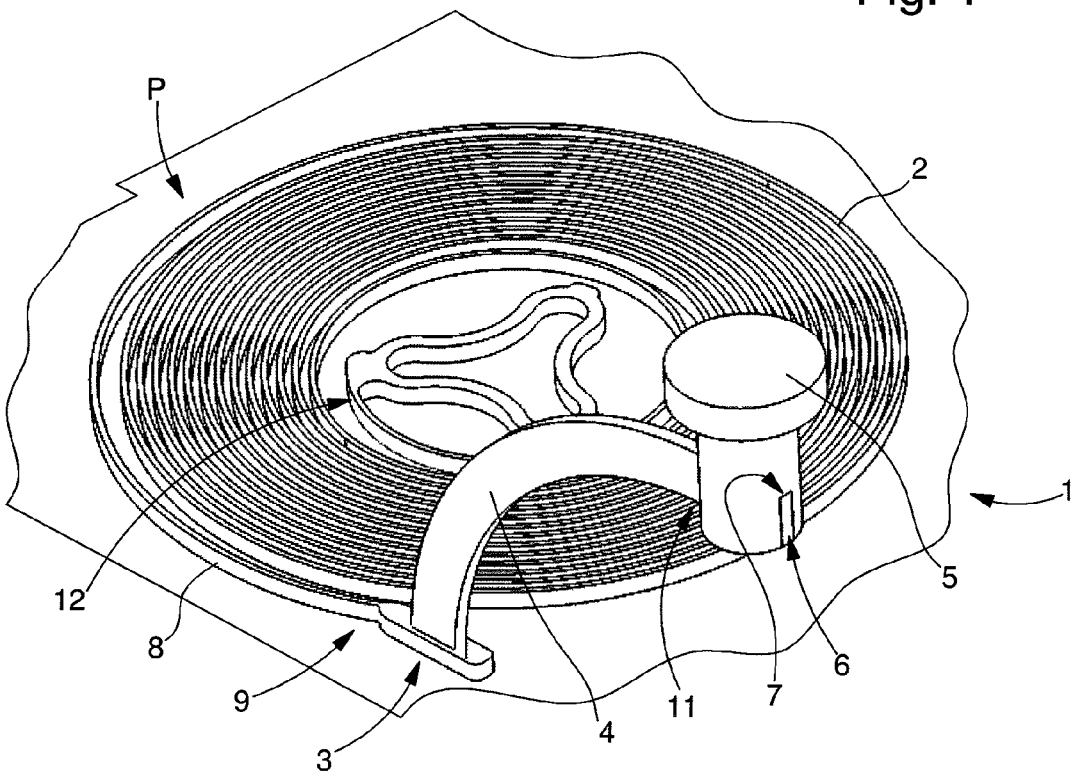
FIG. 1 shows a schematic, perspective view of a silicon balance spring assembly for a timepiece made in accordance with a first variant of the invention, including a terminal curve in a perpendicular plane to that of the spring, shown in the position pinned up to the stud, which is at a distance from the plane of the spring, wherein the smallest dimensions of the smallest section of said terminal curve correspond to the smallest dimension of a wafer from which it originates.

The technical field is that of micro-mechanical components, and in particular timepieces made of micro-machinable material or silicon, or suchlike. More specifically, the field is that of three-dimensional components, such as those comprising regulating members and particularly balance springs, or pallets, or tourbillon carriages or karussels, or suchlike.

The invention is described here more particularly for the preferred application of a balance spring assembly 1 in micro-machinable material or silicon, including a terminal curve 4 joined to a stud 5 of a timepiece 10, said stud 5 being shifted relative to the plane of a flat hairspring 2, in order to pin the balance spring assembly 1 up to the stud.

The invention concerns a method of fabricating a micro-mechanical or timepiece assembly in micro-machinable material or silicon and in three dimensions. "Three dimensions" means that this assembly is developed in space not only in depth, but that perpendicular lines to surfaces comprised in the component intersect the latter at several points, and this assembly cannot be obtained by flat machining or shaping which only allows contouring or pocket machining in a single direction perpendicular to a plane.

According to this method, a prior study phase is followed by a phase of fabricating sub-components, then a phase of assembling the finished component.

For the study phase, the method implements an iterative design process:

the volume of the assembly is broken down into elementary volumes. These elementary volumes are each inscribed in an elementary parallelepiped prism, each corresponding to a wafer determined by the thickness and crystalline orientation thereof. Some of these elementary prisms are oblique or perpendicular in relation to others. These elementary prisms are secant at least in pairs to a junction area, there are naturally as many junction areas as there are intersections between the prisms;

for each elementary prism, a sub-component is formed, including, at each junction area with an adjacent prism, junction means arranged to cooperate with complementary junction means comprised in an adjacent sub-component formed in the adjacent prism;

the geometry of the component formed by the assembly of the various junction areas of these sub-components is checked by calculation;

an assembly method is chosen for each junction area, a particular crystalline orientation is chosen for each sub-component, and a calculation is performed to check whether the mechanical and elastic properties required for the final component are obtained.

During the sub-component fabrication phase, each sub-component is fabricated in a wafer whose crystalline orientation corresponds to that selected for the sub-component. It is clear that the notion of a parallelepiped prism, particular a rectangle, is used solely for the design phase, since the fabrication phase has to be adapted to the format of the wafers available, which may notably be discs.

During the phase of assembling the end assembly, the assembly is assembled by assembling sub-components in pairs in accordance with the assembly method selected for each junction area.

In a preferred implementation of the method, to facilitate implementation, all of the elementary prisms are perpendicular to each other.

In a particular embodiment, the number of sub-components is minimised in the iterative design process.

In another particular embodiment, the thickness of the sub-components is minimised in the iterative design process.

In yet another embodiment, the fabrication cost is minimised in the iterative design process by selecting the minimum accumulated cost in a simulation, during which both the number and thickness of the sub-components are varied.

Assembly at the junction areas can be achieved by any means compatible with micro-machinable material or silicon technology.

The invention therefore concerns a method of fabricating a micro-mechanical assembly in micro-machinable material or silicon including at least a first flat component in micro-machinable material or silicon made in a wafer of micro-machinable material or silicon with a given crystalline orientation, said first component extending on one side from a base plane, characterized in that:

the assembly is broken down into sub-components that can each be made in a wafer of micro-machinable material or silicon with a given crystalline orientation, each said wafer extending parallel to a wafer plane;

junction areas are defined where these sub-components are assembled in pairs and where, on either side of this junction area, the normals to the wafer planes from which each of the sub-components originates, are oblique or perpendicular to each other;

at least one of these sub-components is made to form a second component joining said at least first flat component at a point located, in projection into said base plane, outside said first component;

these sub-components are assembled at the junction areas by assembling means.

In a particular embodiment, the wafer planes of some of the components are perpendicular to each other.

In particular, in a preferred embodiment, the wafer plane of the second component is perpendicular to that of the first component.

Thus, more specifically, the method of fabricating a timepiece balance spring assembly 1 in micro-machinable material or silicon and in three-dimensions including at least a first flat component formed by a hairspring 2 in micro-machinable material or silicon made in a wafer of micro-machinable material or silicon with a given crystalline orientation, said first component extending on one side from a base plane P, includes the following steps:

the volume of said balance spring assembly 1 is broken down into elementary volumes, each inscribed in an elementary parallelepiped prism, said elementary prisms being secant at least in pairs to a junction area, said elementary volumes being perpendicular to each other and forming the same number of sub-components, each made in a wafer of micro-machinable material or silicon determined by the thickness and crystalline orientation thereof, each said wafer extending parallel to a wafer plane;

at least one of said sub-components, called the second component 4, is made to form a terminal curve of said balance spring assembly 1, directly joining said hairspring 2 at a point in space, the projection of which into base plane P is located external to hairspring 2, said terminal curve 4 being in an orthogonal plane to that of hairspring 2;

said sub-components are assembled at said junction areas by assembling means.

Advantageously, so as to resolve numerous joining or attachment problems in space, the second component, in particular a terminal curve 4, has the form of a curve, and includes at least one curvature in the plane located between the two parallel faces closest to the wafer from which it originates, and whose centre of curvature is located between these parallel faces.

As visible in the Figures, terminal curve 4 joins said flat hairspring 2 at a stud 5 which is located, in projection into base plane P, outside hairspring 2.

In a first variant, the smallest dimension of the smallest section of the second component, in particular of a terminal curve 4, corresponds to the smallest dimension of the wafer from which it originates.

In a second variant, the largest dimension of the smallest section of the second component, in particular a terminal curve 4, corresponds to the smallest dimension of the elementary prism from which it originates.

Among the various possible assembly methods, the use of at least one of the following assembly methods is more particularly preferred. These methods may naturally be differentiated depending upon the location and stresses of the junction area:

one assembly method is achieved by bonding the junction means of one component to the complementary junction means of an adjacent sub-component, said junction means and complementary junction means being devised with an assembly clearance suited for bonding;

one assembly method is achieved by clamping the junction means of one component to the complementary junction means comprised in an adjacent sub-component. At least the junction means or the complementary junction means includes at least one elastic element arranged for immobilising, respectively the complementary junction means or the junction means. Naturally, the junction means and the complementary junction means may each include an elastic element.

To facilitate assembly, and in particular to ensure perfect reproducibility from one assembled component to another, advantageously at least one of the junction areas includes first stop means comprised in the junction means of one component, and which is arranged to cooperate with complementary first stop means comprised in complementary junction means belonging to an adjacent sub-component.

In a particular variant, these first stop means and/or these first complementary stop means are completed by second stop means, which is arranged to immobilise the sub-component and adjacent sub-component together.

Owing to the elasticity of the micro-machinable material, particularly when it is formed by silicon, it is especially advantageous for this second stop means to include at least one elastic element arranged to allow assembly of the sub-component and adjacent sub-component and to prevent the disassembly thereof. For example, with a junction area with an eye, as seen in the Figures, one of the sub-components, for example a flat hairspring, includes an eyelet into which the end of the other sub-component is inserted, for example a terminal curve: this end includes a stop member (not shown in the Figures), forming first stop means, which cooperates with complementary first stop means formed by one of the faces of the eyelet, and it further includes (not shown in the Figures) an elastic strip that can clip into a corresponding housing in the terminal curve during insertion into the eyelet, and returned to the stop position behind the other face of the eyelet, with which it cooperates via a free end in return. Thus assembly precision and security are both ensured.

Preferably, all of the components of this assembly are made of silicon.

More particularly, the invention has been developed to improve a method of fabricating a balance spring assembly 1 for a timepiece 10 in micro-machinable material or silicon. This balance spring assembly 1 includes at least one such first component formed by a flat hairspring 2 in micro-machinable material or silicon, which is made in a wafer of micro-machinable material or silicon with a given crystalline orientation, said flat hairspring 2 extending on one side from a base plane P. This flat hairspring 2 is arranged to cooperate on the internal coil side thereof with a collet, or to include a collet at the end of the internal coil thereof. The balance spring assembly 1 according to the invention associates, with hairspring 2, means for the indirect attachment thereof to a stud 5, belonging to a timepiece 10 and shifted relative to the latter.

According to the invention:

balance spring assembly 1 is broken down into sub-components, each made in a silicon wafer of given crystalline orientation, each wafer extending parallel to a wafer plane peculiar thereto;

junction areas 3 are defined where these sub-components are assembled in pairs and where, on either side of the junction area assembling two particular sub-components, the normals to the wafer planes from which each of the sub-components originates, are oblique or perpendicular to each other;

at least one of these sub-components is made to form a second component of this type, comprising a terminal curve joining said at least flat hairspring to a stud, which is located, in projection into said base plane, outside the hairspring, external to the area covered thereby;

these sub-components are assembled at the junction areas by assembling means.

In order notably to simply execution, the wafer planes of some of said sub-components are perpendicular to each other. In a particular embodiment, they are all in perpendicular pairs.

In a preferred embodiment, the wafer plane of terminal curve 4 is perpendicular to that of flat hairspring 2, i.e. to base plane P.

Figure 2:
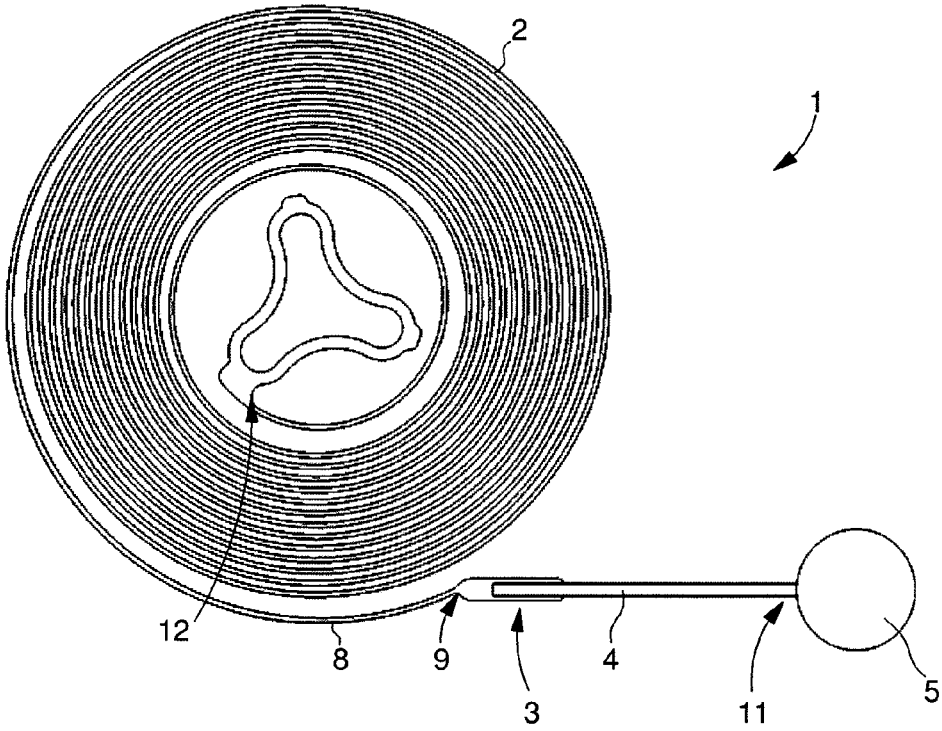
FIG. 2 is a schematic front view of the balance spring assembly of FIG. 1, pinned up to the same stud.

Two variants are shown in the Figures, which differ in the relative position of stud 5 and hairspring 2. In FIGS. 1 and 2, terminal curve 4 is substantially tangential relative to hairspring 2, and stud 5 is substantially on a tangential plane to the outermost coil 8 of hairspring 2, whereas in FIGS. 3 and 4, stud 5 occupies a substantially radial position relative to the end 9 of the outermost coil 8 and terminal curve 4 extends substantially perpendicularly thereto. It is clear that it is possible to adjust the morphology of terminal curve 4 according to the position of stud 5.

In these two variants, preferably, as seen in the Figures, terminal curve 4 has at least one curvature in the plane located between the two faces closest to the wafer from which it originates, and whose centre of curvature is located between these parallel faces.

In a first variant, as seen in FIGS. 1 and 2, the smallest dimension of the smallest section of terminal curve 4 corresponds to the smallest dimension of the wafer from which it originates.

Figure 3:
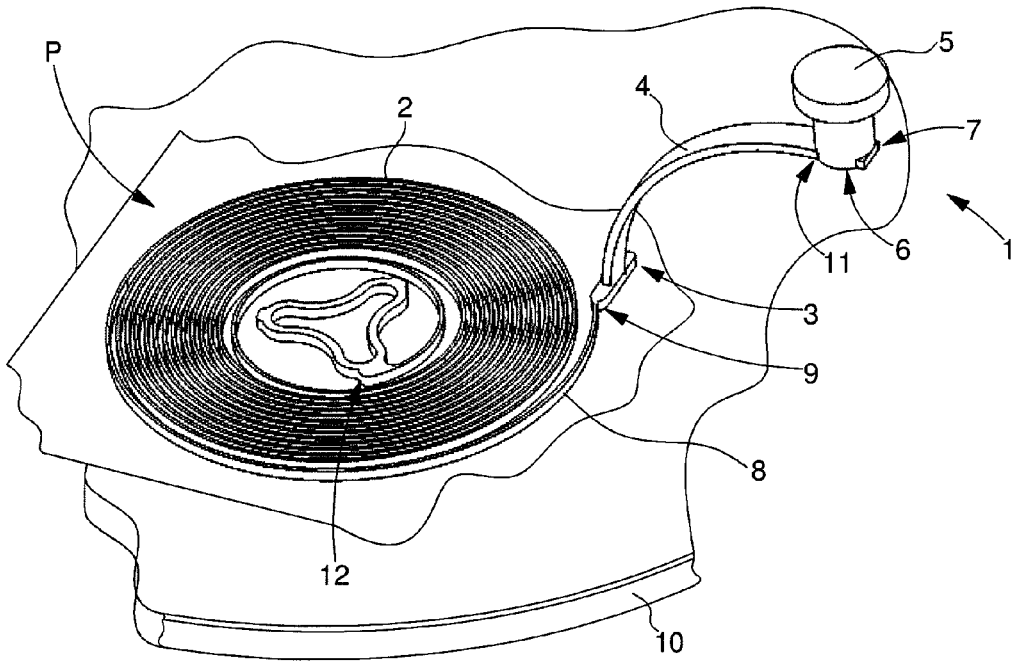
FIG. 3 shows, in a similar manner to FIG. 1, a partial, schematic, perspective view of a silicon balance spring assembly, pinned up to a timepiece stud, in a second variant, wherein the largest dimension of the smallest section of said terminal curve corresponds to the smallest dimension of a wafer from which it originates.
Figure 4:
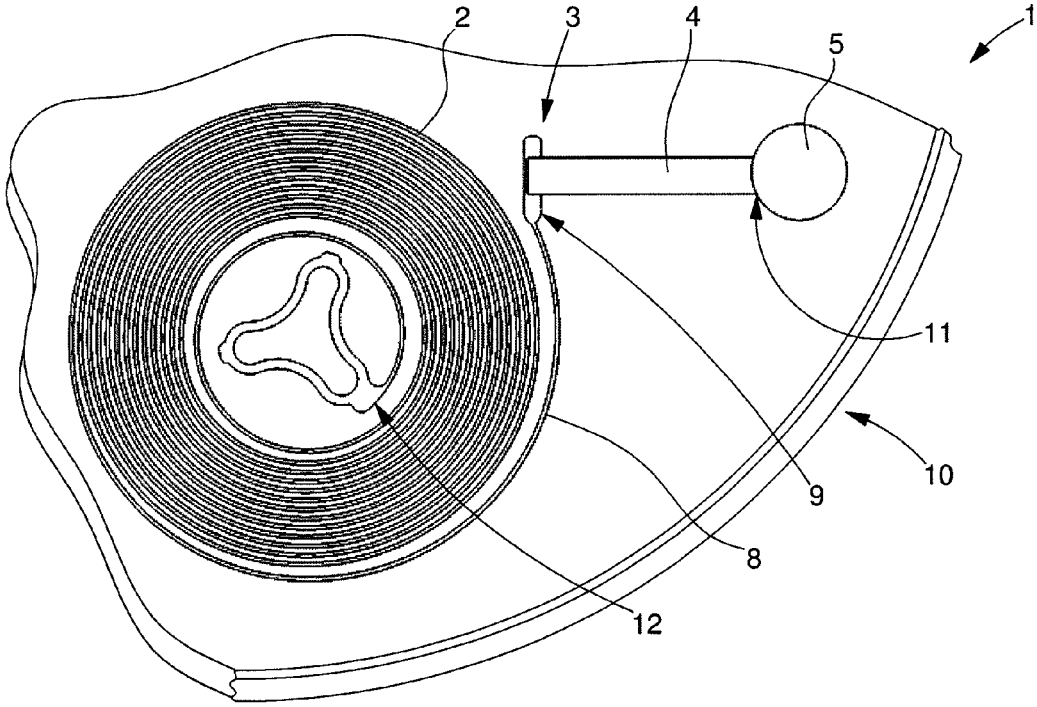
FIG. 4 is a schematic, partial, front view of the balance spring assembly of FIG. 3, pinned up to the same timepiece stud.

In a second variant, as seen in FIGS. 3 and 4, the largest dimension of the smallest section of terminal curve 4 corresponds to the smallest dimension of said elementary prism from which it originates.

Preferably, as seen in the Figures, balance spring assembly 1 includes only terminal curve 4 and flat hairspring 2.

Stud 5, which forms part of the timepiece 10 incorporating the balance spring assembly, has securing means 6 for attaching said assembly. Terminal curve 4 preferably includes complementary securing means 7, at the second end 11 thereof opposite flat hairspring 2, arranged for assembling and securing said curve to securing means 6 of stud 5. Complementary securing means 7 preferably has a complementary profile arranged for cooperating by nesting in or bonding with a profile comprised in securing means 6 of the stud. For example, securing means 6 of stud 5 is a notch and complementary securing means 7 is a catch. Naturally first and second stop means similar to those described above may be fitted to this particular junction.

As regards this type of balance spring, implementation of the invention also means that the inner end 12 of hairspring 2 can be arranged on the collet side. In particular, with the same method, hairspring 2 may also be assembled, on the inner coil side thereof, with a sub-component forming an inner "Grossmann curve".

Likewise, hairspring 2 may be assembled on the inner coil side thereof, with a sub-component forming a collet of greater thickness than hairspring 2.

The sub-components may be joined by nesting fit, with or without clips, by bonding, welding or soldering. These assembly methods may be combined.

The assembled balance spring assembly 1 may be made with a hairspring 2 and a terminal curve 4 originating from the same wafer. However, as has been seen, in some configurations, it may be advantageous to prefer particular crystalline orientations for some sub-components, so as to best exploit their elastic properties in particular directions.

Preferably, all of the components of this assembly are made of silicon.

The invention thus concerns a timepiece balance spring assembly 1 including a flat hairspring 2 and a terminal curve 4. This assembly is achieved by implementing the invention and it is intended to be attached to a point of attachment 5 of a timepiece which includes securing means 6. This balance spring 1 includes at least one such first component 2 or flat hairspring in a base plane P, such that the projection of this point of attachment 5 into base plane P and hairspring 2 are external to each other. It further includes at least said terminal curve 4 for attaching assembly 1 to point of attachment 5.

This terminal curve 4 includes complementary securing means 7 arranged for the assembly and securing thereof to securing means 6 of point of attachment 5, in particular a stud.

Terminal curve 4 and flat hairspring 2, each in micro-machinable material or silicon are assembled to each other at a junction area 3 and are in oblique or perpendicular planes relative to each other. In a preferred embodiment, all of the components of this balance spring assembly 1 are made of silicon.

The invention also concerns a timepiece including at least one point of attachment 5 which includes securing means 6. According to the invention, timepiece 10 includes at least one assembly 1, in particular a timepiece balance spring assembly 1, made via the method described above, in any of the variants thereof, and includes at least one first component 2 or hairspring and at least a second component 4 or terminal curve, said second component 4 or terminal curve being arranged for attaching assembly 1 at point of attachment 5. This second component 4 or terminal curve includes complementary securing means 7 arranged for the assembly and securing thereof to securing means 6 of point of attachment 5.

The invention also concerns a timepiece 10 including at least one stud 5 for attaching a balance spring, wherein said stud 5 includes securing means 6, said timepiece 10 includes at least one balance spring 1 obtained via the method of the invention, and includes a flat hairspring 2 and a terminal curve 4, each in micro-machinable material or silicon, and wherein terminal curve 4 includes complementary securing means 7 arranged for the assembly and securing thereof to securing means 6 of said stud 5.

What is claimed is:

1. A method of fabricating a timepiece balance spring assembly in micro-machinable material or silicon and in three dimensions, including at least a first flat component formed by a hairspring in micro-machinable material or silicon made in a wafer of micro-machinable material or silicon with a given crystalline orientation, said first component extending on one side from a base plane, wherein the method comprises:

breaking down the volume of said balance spring assembly into elementary volumes, respectively inscribed in elementary parallelepiped prisms, said elementary prisms being secant at least in pairs to a junction area, said elementary volumes being perpendicular to each other and forming the same number of sub-components, each made in a wafer of micro-machinable material or silicon determined by the thickness and crystalline orientation thereof, each said wafer extending parallel to a wafer plane between two main parallel faces of the wafer;

making at least one of said sub-components to form an outer curve of said balance spring assembly, directly joining said at least one hairspring at a point in space, the projection of which into said base plane is located external to said hairspring, said outer curve being in an orthogonal plane to that of said at least one hairspring; and assembling said sub-components at said junction areas by assembling means.

2. The method according to claim 1, wherein said outer curve includes at least one curvature in the wafer plane located between said two closest main parallel faces of said wafer from which said outer curve originates, and whose centre of curvature is located between said parallel faces.

3. The method according to claim 1, wherein said outer curve joins said at least one flat hairspring to a stud located, in projection into said base plane, outside said hairspring.

4. The method according to claim 1, wherein said outer curve has a "Phillips" curve type profile.

5. The method according to claim 1, wherein said balance spring assembly includes only said outer curve and said flat hairspring.

6. The method according to claim 1, wherein said flat hairspring is arranged to cooperate on an inner coil side thereof with a sub-component formed by a collet.

7. The method according to claim 1, wherein a smallest dimension of a smallest section of said outer curve corresponds to a smallest dimension of the wafer from which said outer curve originates.

8. The method according to claims 1, wherein a largest dimension of a smallest section of said outer curve corresponds to a smallest section of said elementary prism from which said outer curve originates.

9. The method according to claim 1, wherein assembly of said sub-components is achieved by clamping between junction means of one component and complementary junction means comprised in an adjacent sub-component, at least said junction means or said complementary junction means including at least one elastic element arranged for immobilising, respectively, at least said complementary junction means or said junction means.

10. The method according to claim 1, wherein at least one said junction area includes first stop means, which is comprised in junction means of one component, and arranged for cooperating with complementary first stop means comprised in complementary junction means belonging to an adjacent sub-component.

11. The method according to claim 10, wherein said first stop means and/or said first complementary stop means are completed by second stop means arranged for immobilising together said sub-component and said adjacent sub-component.

12. The method according to claim 11, wherein said second stop means includes at least one elastic element arranged to allow the assembly of said sub-component and said adjacent sub-component and to prevent the disassembly thereof.

* * * * *